166-308 SR

2/28/78 OR 4,076,079

United States Patent [19]

Herricks et al.

[11] 4,076,079

[45] Feb. 28, 1978

[54] FULL BORE FRACTURE TREATING ASSEMBLY

[75] Inventors: Herman H. Herricks, Azle, Tex.; Richard L. Easterwood, Slidell, La.

[73] Assignee: Shell Oil Company, Houston, Tex.

[21] Appl. No.: 714,869

[22] Filed: Aug. 16, 1976

[51] Int. Cl.[2] ..... E21B 43/26; E21B 23/00

[52] U.S. Cl. ..... 166/308; 166/315; 166/75 R

[58] Field of Search ..... 166/308, 315, 75, 85; 251/1; 73/151

[56] References Cited

U.S. PATENT DOCUMENTS

| | | | |
|---|---|---|---|
| 1,811,422 | 6/1931 | Brown | 166/80 |
| 3,025,912 | 3/1962 | Schramm et al. | 166/85 |
| 3,163,220 | 12/1964 | Haeber et al. | 166/75 |
| 3,227,229 | 1/1966 | Wakefield, Jr. | 166/75 |
| 3,391,735 | 7/1968 | Schramm et al. | 166/85 |

*Primary Examiner*—James A. Leppink

[57] ABSTRACT

A full bore fracture treating assembly is provided for use on oil and gas wells during a fracture treatment down casing to provide a full bore capability for running a casing packer or perforating gun with wellhead pressure remaining at the surface. The assembly includes a modified tubing hanger which isolates blowout preventors on the well from pressure during the treatment, a section of casing to extend through the blowout preventor stack, and a side outlet spool which enables the pumping of fracturing fluids into the well. In addition, a set of blind ram blowout preventors and a full bore lubricator or a valve can be placed on top of the spool as desired to contain pressure and provide full bore access into the well.

8 Claims, 2 Drawing Figures

FULL BORE FRACTURE TREATING ASSEMBLY

BACKGROUND OF THE INVENTION

Hydraulic fracturing is the parting of a desired section of an oil or gas bearing formation by the application of hydraulic pressure. The fracture made in this manner may be extended from the well bore by continued pumping. The extending distance depends on several factors such as injection rate, formation characteristics and fracturing fluid properties. Selected particles, added to the fracturing fluid, are transported into the fracture. These act as propping agents to hold the fracture open when the applied pressure is dissipated, thus leaving a channel of high flow capacity connected to the well bore. Because of the above-mentioned factors, in some wells it is necessary to use higher than usual pressure to accomplish satisfactory fracturing. Due to a high pressure loss in fracturing through tubing or "down tubing", it is necessary to fracture through the casing or "down casing" in such wells. As will be described more fully hereinafter, previous practice was to put a single joint of tubing down to a tubing spool to protect blowout preventors from the above mentioned selected particles and then pass fracturing fluid through this joint of tubing and into the well casing in order to fracture down casing. High costs were incurred when taking that joint of tubing out of the well under high well pressure and then putting a packer down casing either with tubing or with a wireline to secure the fracturing fluid in the well and release well pressure above the packer.

Accordingly, the present invention seeks to overcome the above and other problems in connection with high pressure fracturing as more particularly described hereinafter.

SUMMARY OF THE INVENTION

The primary purpose of this invention resides in providing a full bore capability in an oil or gas well for running a casing packer or perforating gun with wellhead pressure remaining at the surface during and after fracture treatment of the well.

The above purpose has been achieved by the use of a full bore fracture treating assembly which isolates blowout preventors on the well from pressure during and after fracture treatment.

More specifically, in accordance with the method of the invention, full bore access is provided into a well casing during fracture treatment of the well by isolating blowout preventors on the well from fracture fluid in the well with a tubing hanger of substantially the same inner diameter as the casing in the well.

In accordance with the apparatus of the invention, full bore access into an oil or gas well casing during fracture treatment of the well is provided with a tubing hanger substantially the same inner diameter as the casing and having one end slightly enlarged, a tubing spool having an opening extending therethrough, one end of the opening being adapted to receive the enlarged end of the tubing hanger and the other end of the opening adapted to receive the casing, the tubing hanger sealingly abutting with the spool.

Within the framework of the above described method and apparatus, the present invention not only solves the above mentioned problems of the prior art but also achieves further advantages as will appear hereinafter.

DESCRIPTION OF PREFERRED EMBODIMENTS

In the case of certain oil and gas wells, hydraulic fracturing is done under very high pressures, due to the nature of the formation, characteristics of the fracturing fluid, etc. The pressure drop in tubing in such oil and gas wells is high due to the relatively small diameter of the tubing, and accordingly, it is desirable to fracture down casing, which is larger than the tubing, instead of down tubing. This procedure is relatively expensive since it requires putting in a single joint of tubing down to a tubing spool and removing the joint tubing after fracturing under full well pressure and then putting down a packer either with tubing or a wireline. This requires a separate snubbing unit crew to perform the operation of removing the tubing and about a day of rig time, all of which being fairly expensive.

Figure 1:
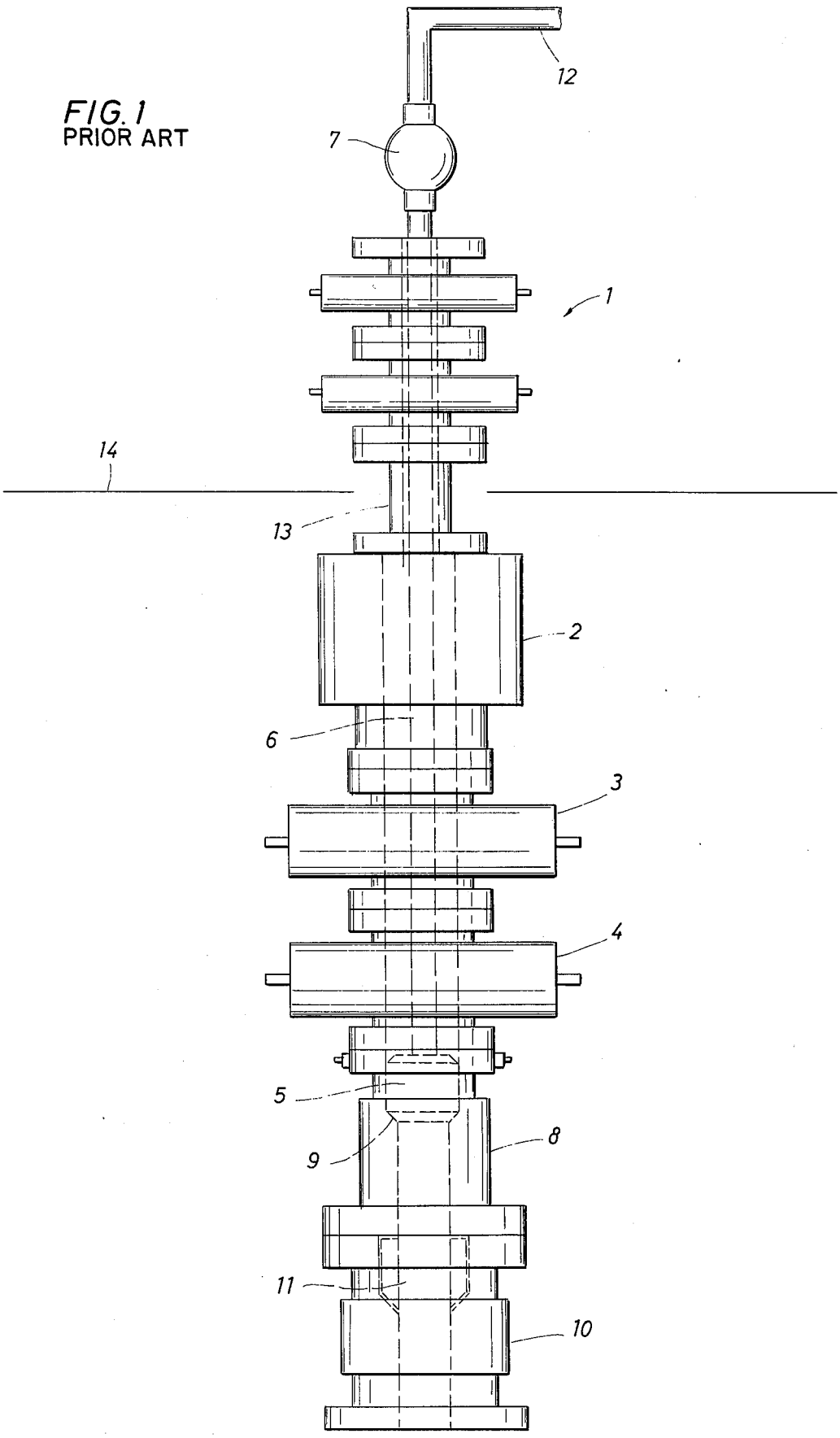
FIG. 1 PRIOR ART
FIG. 1 depicts the apparatus of the prior art.

The prior art apparatus is shown in FIG. 1 of the drawings. In utilizing that apparatus, the first step is to install snubbing unit blowout preventor stack 1 on top of the regular blowout preventors 2, 3 and 4. Blowout preventor 2 has a rubber unit sealingly fitting around the pipe which is movable therewithin; blowout preventor 3 is a conventional pipe blowout preventor and blowout preventor 4 is a blind blowout preventor. The second step is to place a tubing hanger 5, one joint of tubing 6 and a safety valve 7 through the blowout preventor assembly as shown. The tubing hanger 5 seals in the tubing spool 8 along beveled edges 9 to prevent harmful effects of the fracturing fluid on the blowout preventors, e.g. erosion by the sand and corrosion by other components of the fracturing fluid. The tubing spool is located concentrically above casing spool 10 having casing 11 extending therethrough. Step three is to install pump trucks and fracturing lines 12 and then fracture-treat the well. The well is left full of fluid with sufficient density to overbalance normal formation pressures after treatment of the well. This will not overbalance the pressure of the formation supercharged by the fracturing fluid however. Thus, the well will have pressure remaining on it during subsequent steps. Step four is to snub tubing hanger 5, joint of tubing 6, and safety valve 7 out of the blowout preventors 1–4. In step 5 the packer is snubbed into the well under wellhead pressure. This is done with tubing (not shown). An alternate step five is to remove snubbing unit blowout preventors 1 and a spacer spool 13 which is located at the level of rig floor 14 and install a lubricator (not shown) with the packer (not shown) and run and set the packer with a wireline (not shown). The packer has an expendable plug to shut off pressure in the well as more particularly shown in FIG. 2 described hereinafter. The difference between alternate step five and original step five is primarily in use of a wireline instead of tubing to place the packer. Where the corrosiveness of the well is high, it may be necessary to use tubing to place the packer instead of a wireline which is highly susceptible to corrosion. Thus, although it is preferable to use a wireline due to cost incentives, particularly valuable rig time, it may be necessary to use tubing to place the packer. As a final step six, after the pressure has been released on the well above the packer, tubing (not shown) is run to the packer (not shown) and a typical wellhead (not shown) is installed.

Figure 2:
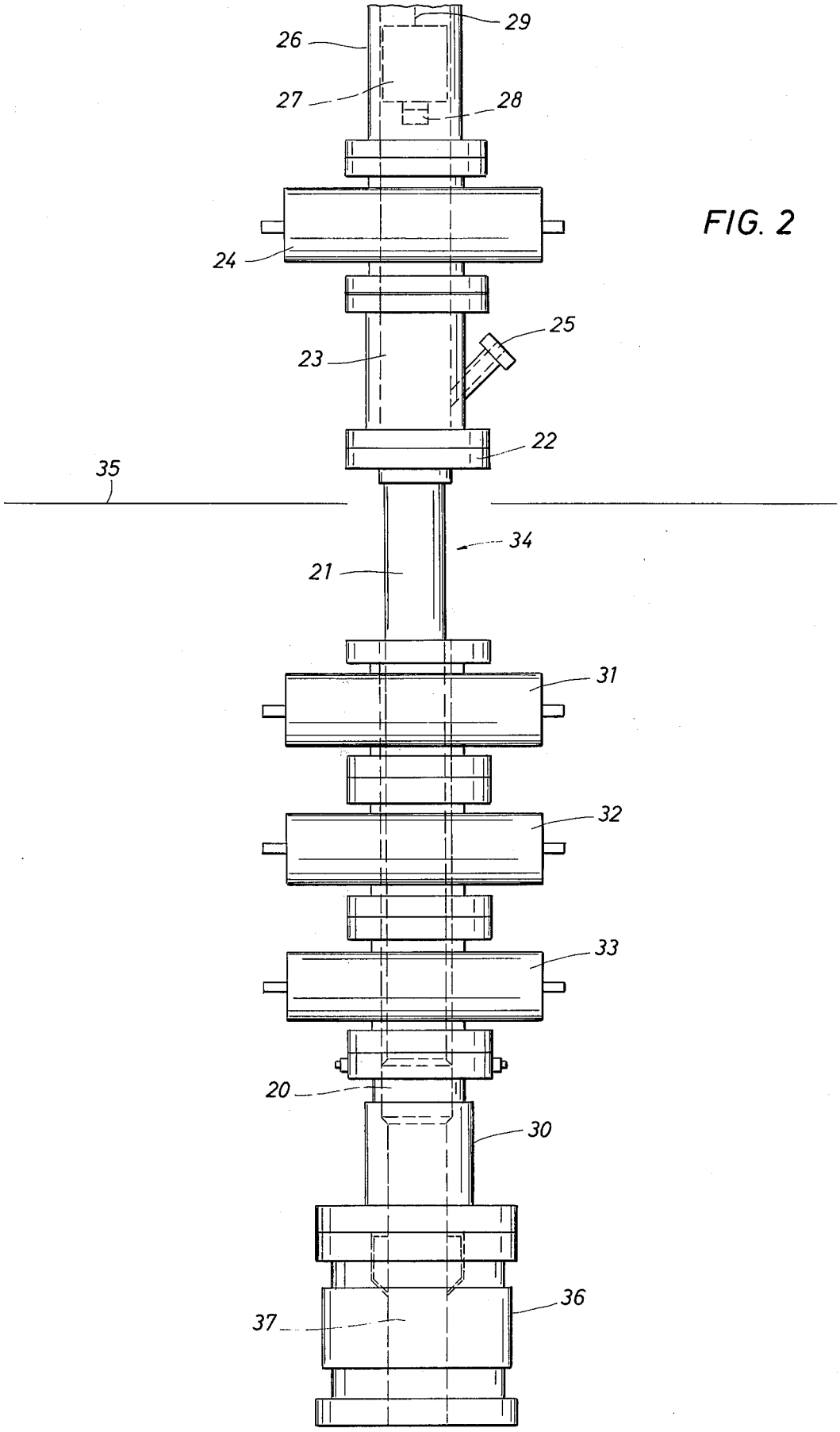
FIG. 2 shows the improvement of the present invention.

The improved apparatus of the present invention is shown in FIG. 2. In step one a modified tubing hanger 20 is installed integrally with a section casing 21 with a flange, fracturing spool 23, blind blowout preventors 24, and a large bore high pressure lubricator 26. The fracture spool 23 is provided with a 45° angle side outlet 25 for introducing fracturing fluid into the well beneath the large bore high pressure lubricator 26. A packer 27 with an expendable plug 28 as previously described with regard to the old method of FIG. 2 is suspended by a wireline 29 inside the lubricator 26. The tubing hanger 20 seals in the tubing spool 30 to prevent fracture fluid from affecting blowout preventors 31–33 and 24. It is desirable to use one blind blowout preventor and two pipe blowout preventors as shown. Spacer spool 34 and rig floor 35 are arranged as previously shown, as is the same with casing spool 36 and casing 37. Step two requires installing the pump trucks and fracturing lines as previously described. The well is then fracture-treated and left full of fluid with sufficient density to overbalance the normal formation pressures after treatment. This will not overbalance the pressure of the formation super-charged by the fracture fluid. Thus, the entire well will have pressure remaining on it until after the packer is set. In step three blind blowout preventor 24 is opened and packer 27 is lowered into the well. The packer is then set and fixed at a desired depth above the formation which is being fractured. Step four, after the packer with plug 28 is set, pressure is released from the well. This allows subsequent steps to be performed without the presence of high pressure as in the old method. Pursuant to step five, the remaining equipment installed in step one is removed from the well. Step 6, tubing is run into the well and connected to the packer. Finally, the wellhead is installed and plug 28 is removed and the well is ready for production.

The present invention is useful not only for running a casing packer but also a perforating gun with wellhead pressure remaining at the surface. The invention is employable in both onshore and offshore wells. While the invention works best with the combination of apparatus shown, various modifications can be made without departing from the spirit of the invention.

We claim as our invention:

1. A method for fracturing down casing in an oil or gas well comprising, providing (a) a tubing hanger which seals with a tubing spool to prevent fracture fluid from affecting blowout preventors located concentrically thereabove and which is modified to support a section casing thereabove to allow full bore access into the well, (b) a fracture spool with an outlet for introducing fracturing fluid into the well, the spool being connected with the tubing hanger via the section casing, (c) closure means located above the fracture spool, and (d) a lubricator located above the closure means with a packer located therewithin; fracture treating the well with the closure means closed; opening the closure means and admitting the packer into the well; and securing the packer at a desired depth above the formation which has been fractured.

2. A method for fracturing down casing in an oil or gas well and for subsequently installing a production well head in the absence of high pressure comprising, providing (a) a tubing hanger which seals with a tubing spool to prevent fracture fluid from affecting blowout preventors located concentrically thereabove and which is modified to support a section casing thereabove to allow full bore access into the well, (b) a fracture spool with side outlet for introducing fracturing fluid into the well, the spool being concentrically connected with the tubing hanger via the section casing, (c) a blind blowout preventor located concentrically above the fracture spool, and (d) a large bore high pressure lubricator located concentrically above the blind blowout preventor with a packer located therewithin; fracture treating the well with the blind blowout preventor closed; opening the blind blowout preventor and admitting the packer into the well via the section casing and modified tubing hanger; securing the packer at a desired depth above the formation which is being fractured; releasing pressure in the well above the pakcer; running tubing into the well and connecting the tubing with the packer; and installing the production well head.

3. The method of claim 2 wherein the packer is deployed by wireline.

4. The method of claim 2 wherein the packer has an expendable plug which is removed when tubing is connected to the packer.

5. An apparatus for fracturing down casing in an oil or gas well comprising, a tubing hanger which seals with a tubing spool to prevent fracture fluid from affecting blowout preventors located concentrically thereabove and which is modified to support a section casing thereabove to allow full bore access into the well; a fracture spool with an outlet for introducing fracturing fluid into the well, the spool being connected with the tubing hanger via the section casing; closure means located above the fracture spool; and a lubricator located above the closure means with a packer deployed therewithin.

6. The apparatus of claim 5 including a wireline for deploying the packer.

7. The apparatus of claim 5 wherein the packer has an expendable plug which is removable for connecting tubing to the packer.

8. An apparatus for fracturing down casing in an oil or gas well and for subsequently installing a production well head in the absence of high pressure comprising, a tubing hanger which seals with a tubing spool to prevent fracture fluid from affecting blowout preventors located concentrically thereabove and which is modified to support a section casing thereabove to allow full bore access into the well; a fracture spool with side outlet for introducing fracturing fluid into the well, the spool being concentrically connected with the tubing hanger via the section casing; a blind blowout preventor located concentrically above the fracture spool; a large bore high pressure lubricator located concentrically above the blind blowout preventor with a packer deployed therewithin; means for fracture treating the well with the blind blowout preventor closed; means for opening the blind blowout preventor and admitting the packer into the well via the section casing and modified tubing hanger; means for securing the packer at a desired depth above the formation which is being fractured; means for releasing pressure in the well above the packer; means for running tubing into the well and connecting the tubing with the packer; and means for installing the production well head.

* * * * *